US005976041A

United States Patent [19]

Banker, Sr.

[11] Patent Number: 5,976,041

[45] Date of Patent: Nov. 2, 1999

[54] ELASTIC RETURNABLE PRACTICE BALL

[76] Inventor: Theodore W. Banker, Sr., 620 W. Adams, Milstadt, Ill. 62220

[21] Appl. No.: 08/611,830

[22] Filed: Mar. 6, 1996

[51] Int. Cl.[6] ..... A63B 43/00

[52] U.S. Cl. ..... 473/576; 473/424

[58] Field of Search ..... 473/575, 576, 473/595, 596, 597, 604, 605, 607, 608, 609, 610, 423, 424, 451, 458, 471, 422, 425, 426, 429, 430

[56] References Cited

U.S. PATENT DOCUMENTS

| | | | |
|---|---|---|---|
| 667,563 | 2/1901 | Oakley . | |
| 795,960 | 8/1905 | Cook . | |
| 830,581 | 9/1906 | Fleischman | 473/423 |
| 2,547,746 | 4/1951 | Rankin | 473/424 |
| 3,687,453 | 8/1972 | Fraga . | |
| 3,693,972 | 9/1972 | Minchin | 473/575 |
| 3,843,126 | 10/1974 | Bandy . | |
| 3,862,757 | 1/1975 | Craig, II . | |
| 3,934,873 | 1/1976 | Griffin . | |
| 3,940,133 | 2/1976 | Civita | 473/424 |
| 4,042,241 | 8/1977 | Collins . | |
| 4,079,934 | 3/1978 | Nixon . | |
| 4,121,822 | 10/1978 | DiSabatino et al. | 473/576 |
| 4,127,268 | 11/1978 | Lingren . | |
| 4,162,790 | 7/1979 | Kelsey | 473/575 |
| 4,248,423 | 2/1981 | Lotfy . | |
| 4,415,155 | 11/1983 | Goudreau et al. | 473/424 |
| 4,660,835 | 4/1987 | Locurto . | |
| 4,687,209 | 8/1987 | Carey | 473/424 |
| 5,080,376 | 1/1992 | Lerner et al. . | |
| 5,094,462 | 3/1992 | Boyle et al. . | |

*Primary Examiner*—Steven Wong
*Attorney, Agent, or Firm*—Stroock & Stroock & Lavan LLP

[57] ABSTRACT

A ball practice apparatus for use with a solid core ball is provided having an elastic adapted to be secured about a user's body part where an elastic cord attached to the elastic band and a plug is attached to the other end of the elastic cord. The plug is formed with an elongated body portion and a bore formed coaxially therethrough. The plug is also formed with a continuous circular anchor portion at one end. The solid core ball is connected to the elastic cord by imbedding the plug in the solid core ball so that the plug extends less than the full diameter of the ball. A ball practice apparatus for use with a two part ball inflatable ball is also provided having a two part inflatable ball formed of an outer resilient layer and an inner malleable airtight layer with a plurality of thread holes formed in the outer layer. One or more stitching members extend between each pair of the plurality of holes. A latchable hook able to be attached or removed from the stitching members is also attached to an elastic cord. The other end of the elastic cord is attached to an elastic band which may be secured about a user's body part.

13 Claims, 5 Drawing Sheets

ELASTIC RETURNABLE PRACTICE BALL

BACKGROUND OF THE INVENTION

This invention relates generally to an apparatus, and method of forming an apparatus, for allowing a single user to practice using a ball so that the user can kick or throw the ball away from him or her, and the ball will return, and more particularly to an apparatus, and a method for forming the apparatus, of attaching an elastic cord to a ball to produce the above-mentioned results. While individual practice devices with balls have taken various forms in the past, none have sufficiently allowed a user to practice playing a variety of sports involving a ball by his or herself.

For example, for use of a practice device with a solid core ball such as a baseball, in the past a bore has been formed in the ball which passes all the way through the diameter of the ball. Thereafter, a plug is inserted into the ball to hold a cord within the ball. Finally, a cap is placed over the end of the bore opposite where the cord emanates from. Alternatively, a bore has been formed in a ball, and then a loop passed through the bore, one end of the loop emanating from each side of the bore. Finally, bores passing less than the full diameter of the ball have been used. In each of these situations, the other end of the cord is attached to some part of the user's body. However, these have always held the ball insufficiently and have been relatively difficult to fabricate.

For use of a practice device with an inflatable ball, the prior art has been even less useful. A two-piece inflatable ball has been placed in a net which closes around the ball. Upon closure, a cord attached to the net may be attached to the ground. However, this results in the situation that the user must come into contact with the net before coming in contact with the ball, thus taking away some of the realism in the practice device.

SUMMARY OF INVENTION

Generally speaking, and in accordance with the present invention, an apparatus, and method of forming an apparatus, for allowing a user to practice with a ball alone is provided which allows a user to practice throwing or kicking a ball without the risk of losing the ball, and without needing a partner to partake in this exercise. For use of this invention with a ball having a solid core, an elastic cord is first attached to a plug member having an anchor portion. Thereafter, this plug member is inserted into the solid core ball, thereby retaining one end of the elastic cord within the solid core ball. This plug member does not extend the full diameter of the ball but is inserted sufficiently for the anchor to engage the interior of the ball, and so that the plug member does not protrude from the ball.

For use of the present invention with an inflatable ball, stitching members are attached to the outer leather, or other resilient layer, being sure not to damage the inner malleable air tight layer. Thereafter, a hook connected to an elastic cord is connected to the stitching members thereby allowing the ball to remain connected to the elastic cord. In each case, an elastic band is provided and is connected by a swivel joint to the elastic cord for attaching the elastic cord to a user's body part.

Accordingly, it is an object of this invention to overcome the shortcomings of the prior art.

It is another object of this invention to provide an improved apparatus for allowing one to practice throwing or catching a ball without a partner.

Another object of the invention is to provide an improved apparatus and method for allowing one to practice individually with a solid core ball.

A further object of the invention is to provide an apparatus and method for producing this apparatus for allowing a user to practice individually with an inflatable ball.

Still other objects and advantages of the invention will in part be obvious and will in part be apparent from the specification.

The invention accordingly comprises the several steps and the relation of one or more of such steps with respect to each of the others, and the apparatus embodying features of construction, combinations of elements and arrangement of parts which are adapted to affect such steps, all as exemplified in the filing detail disclosure, and the scope of the invention will be indicated in the claims.

BRIEF DESCRIPTION OF THE DRAWINGS

For a fuller understanding of the invention, reference is had to the following description, taken in connection with the accompanying drawings in which.

DETAILED DESCRIPTION OF THE PREFERRED EMBODIMENTS

Figure 1:
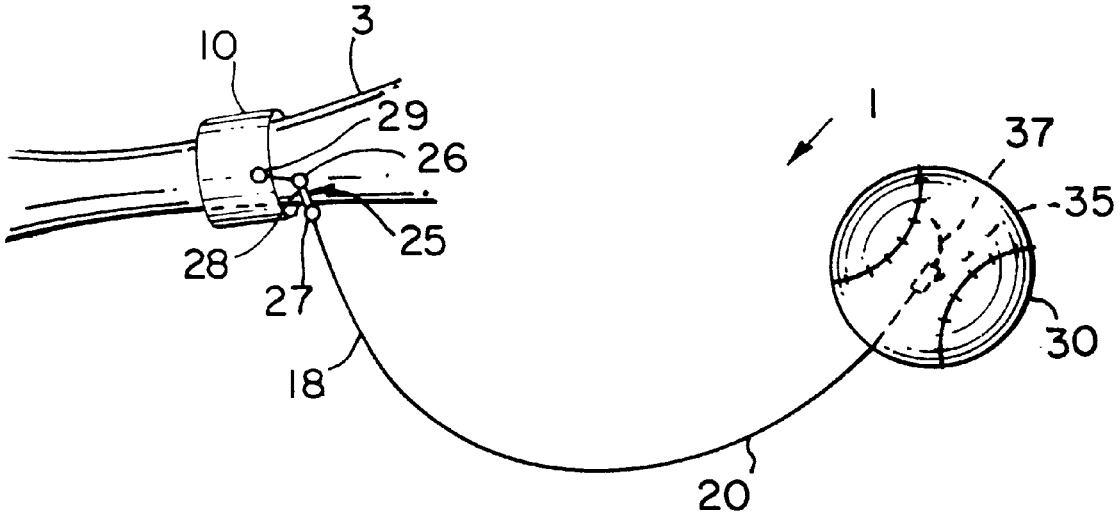
FIG. 1 is a perspective view of an apparatus for practicing with a solid core ball constructed in accordance with a first embodiment of the invention.
Figure 2:
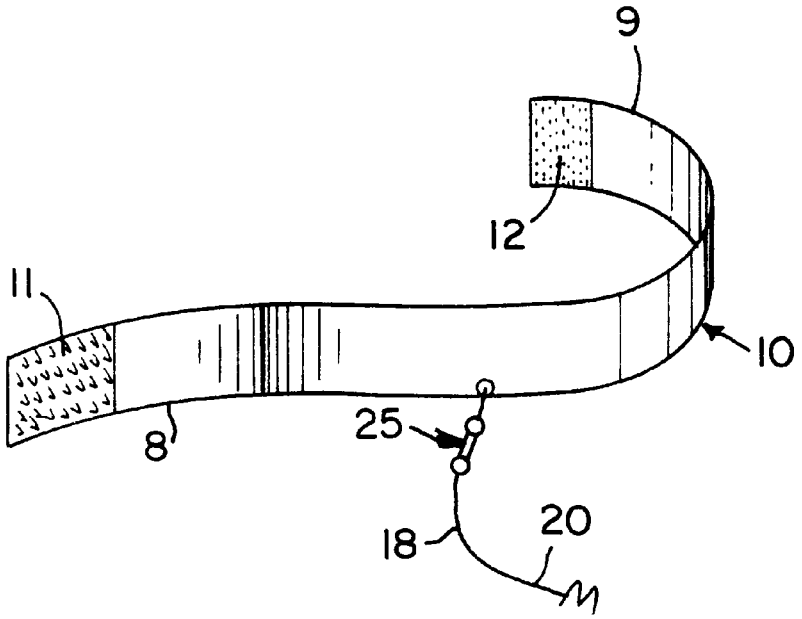
FIG. 2 is a perspective view of the wristband and associated components of the apparatus of FIG. 1.
Figure 3A:
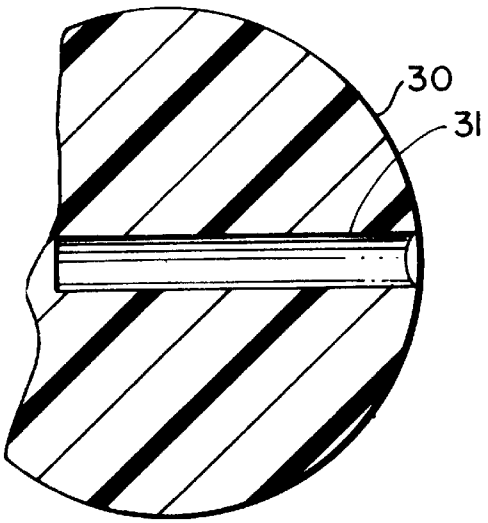
FIG. 3*a* is an exploded perspective view showing an number of parts which are combined in order to form the apparatus of FIG. 1.
Figure 3A:
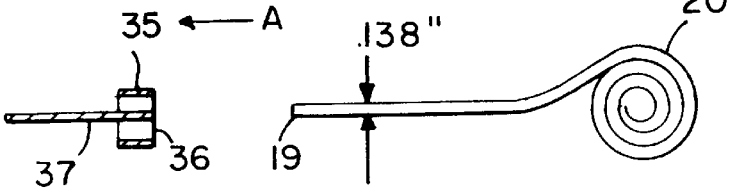
Figure 3B:
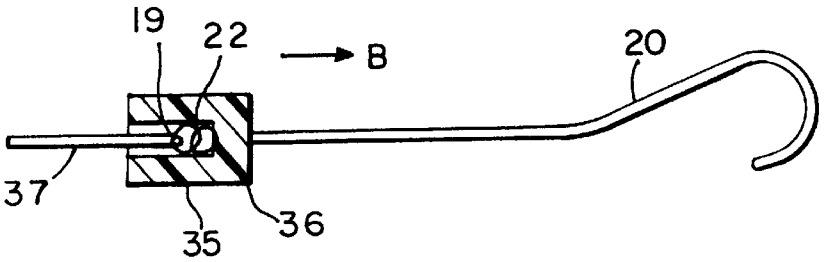
FIG. 3*b* is a perspective view showing the apparatus of FIG. 3*a* after being partially combined.
Figure 3C:
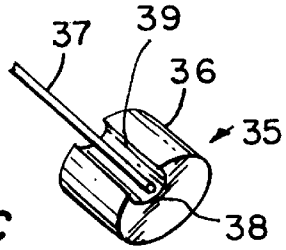
FIG. 3*c* is a perspective view of the plug member of FIG. 3*a;*

Referring now to FIG. 1, a catch and throw ball apparatus 1 is shown which is constructed in accordance with a first embodiment of the present invention. As shown in FIG. 2, an elastic band 10, constructed of an elastic material and dimensioned to encircle a user's forearm or wrist, is secured around a user's wrist 3. In a preferred embodiment, elastic band 10 is formed from a cotton web material and measures 1.25 inches wide and 10.75 inches long. Alternatively, elastic band 10 may be formed from a polypropylene fabric and measure 1 inch wide and 10.75 inches long. First end 8 and second end 9 of elastic band 10 are adapted to be secured to each other through the use of two part hook and latch type fastener. A portion of the hook side of the hook and latch type fastener 11 may be attached to first end 8 of elastic band 10 and a portion of the latch side of the hook and latch type fastener 12 may be attached to second end 9 of wristband 10. In a preferred embodiment the hook and latch portions of the hook and latch type fastener are each 1 inch long, and are the same width as elastic band 10. However, other sizes of the hook and latch type fasteners, or even other types of fasteners sufficient to retain elastic band 10 around a user's wrist 3 may be used. Therefore, upon encircling user's wrist 3 with elastic band 10, the hook and latch type fastener secures elastic band 10 about user's wrist 3.

As is shown in FIG. 1, when elastic band 10 is attached to a user's wrist 3, an elastic cord 20 is rotatably attached to wristband 10. Elastic cord 20 may be formed of any material sufficiently elastic to allow deformation of the cord in the longitudinal direction sufficient to ensure the user's wrist 3 is not wrenched, yet strong enough to ensure that it will not break, and that solid core ball 10 will be returned to the user. In a preferred embodiment, elastic cord 20 is formed of a mixture of materials. The mixture is made of four parts of a material having a hardness on the Shore A scale of 18, a specific gravity of 0.9 g/cc, a tensile modulus at 300% elongation in the flow direction of 110 psi, a tensile strength at break in the flow direction of 250 psi and a percent elongation at break in the flow direction of 300%. The mixture is also made of five parts of a material having a hardness on the Shore A scale of 65 for injection and 62 for extrusion, a specific gravity of 0.9 g/cc, a tensile modulus at 300% elongation in the flow direction of 600 psi, a tensile strength at break in the flow direction of 1,150 psi and a percent elongation at break in the flow direction of 650%.

In a preferred embodiment, a first end 18 of elastic cord 20 is connected to elastic band 10 by a swivel joint 25. Swivel joint 25 is formed of a first eyelet 26 which is directly attached to elastic band 10 through the use of a rivet 29. First eyelet 26 is attached to a swivel portion 28 which is in turn attached to a second eyelet 27 so that first eyelet 26 and second eyelet 27 can swivel with respect to each other. First end 18 of elastic cord 20 is then attached to second eyelet 27 by tying or another attachment apparatus. Swivel joint 25 allows elastic cord 20 to rotate with respect to elastic band 10, thereby precluding elastic cord 20 from becoming twisted or tangled with itself.

A second end 19 of elastic cord 20, which is not connected to elastic band 10, is fastened to a ball 30. In a preferred embodiment, ball 30 is a soft baseball, but any type of ball formed of a solid material, or a number of materials forming a solid structure, may be used.

Referring now to FIG. 3(*a*), the apparatus for attaching elastic cord 20 to ball 30 is depicted. Elastic cord 20 is first fed through a plug 35 in a direction indicated by arrow A. Plug 35 contains a body portion 36 with an extension 37 extending coaxially with body portion 36 which elastic cord 20 is attached to. As is shown in FIG. 3*c*, plug 35 is formed with a cutout 38 to accommodate elastic cord 20. Plug 35 also contains a reservoir 39 situated about extending portion 37 to accommodate elastic cord 20 and a double knot 22 which will be tied therein. As shown in FIG. 3(*b*), after threading elastic cord 20 through cutout 38 of plug 35, a double knot 22 is tied in second end 19 of elastic cord 20, which has been threaded through plug 35. Double knot 22 is tied around extending portion 37 and therefor fixes elastic cord 20 to extending portion 37. Thereafter, elastic cord 20 is pulled in a direction opposite from the original direction of threading indicated by arrow B, until double knot 22 is retained in reservoir 39. In a preferred embodiment, elastic cord 20 is formed with a diameter of approximately 0.138 inches, body portion 36 is formed with a diameter of 0.375 inches and extending portion is formed with a length of approximately 0.75 inches.

Referring once again to FIG. 3(*a*), a drill hole 31 is formed in ball 30 through the diameter of ball 30, but extending less than the full diameter of ball 30 so as to not protrude out the opposite of ball 30 from the original point of drilling. Drill hole 31 is formed with a diameter slightly smaller than the diameter of body portion 36 of plug 35.

After formation of drill hole 31 in ball 30, plug 35 is inserted into drill hole 31, with the portion of plug 35 containing extending portion 37 being inserted first. Plug 35 is inserted into drill hole 31 of ball 30 by an exertion of pressure on the rear end thereof. After insertion, extending portion 37 is caused to come in contact with the outside of drill hole 31 and catch on the inside of solid core ball 30. Extending portion will thereafter be bent or deformed sideways or laterally slightly and will become embedded in solid core ball 30 (see FIG. 1), thereby further aiding to retain plug 35 within solid core ball 3 upon the exertion of force by elastic cord 20. Upon completion of the insertion of plug 35, elastic band 10 will be attached through swivel joint 25, elastic cord 20, and plug 35 to ball 30. Thereafter, upon attachment of elastic band 10 to user's wrist 3, the user may throw or move ball 30 away from the user in any other manner, and elastic cord 20 will extend and become deformed in the lengthwise direction. Ball 30 will then be returned to the user when elastic cord 20 reforms into its original form.

Figure 4:
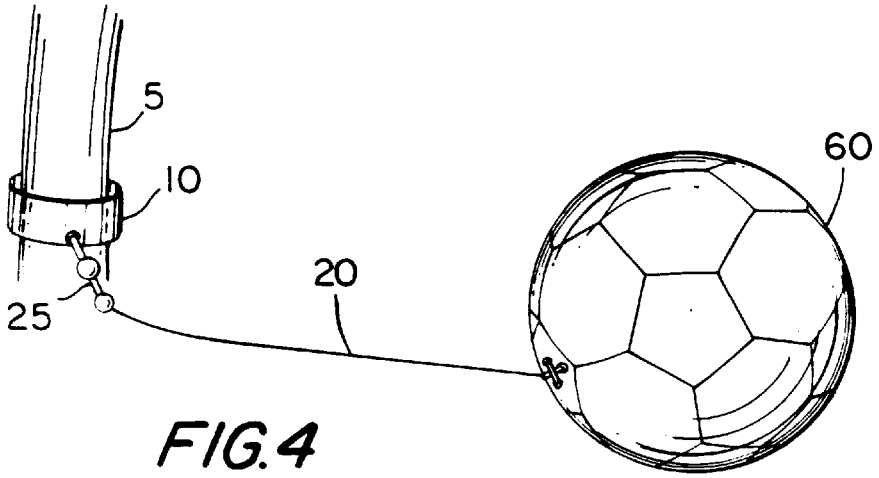
FIG. 4 is a perspective view of an apparatus for a user practicing with a two-piece inflatable ball.
Figure 6:
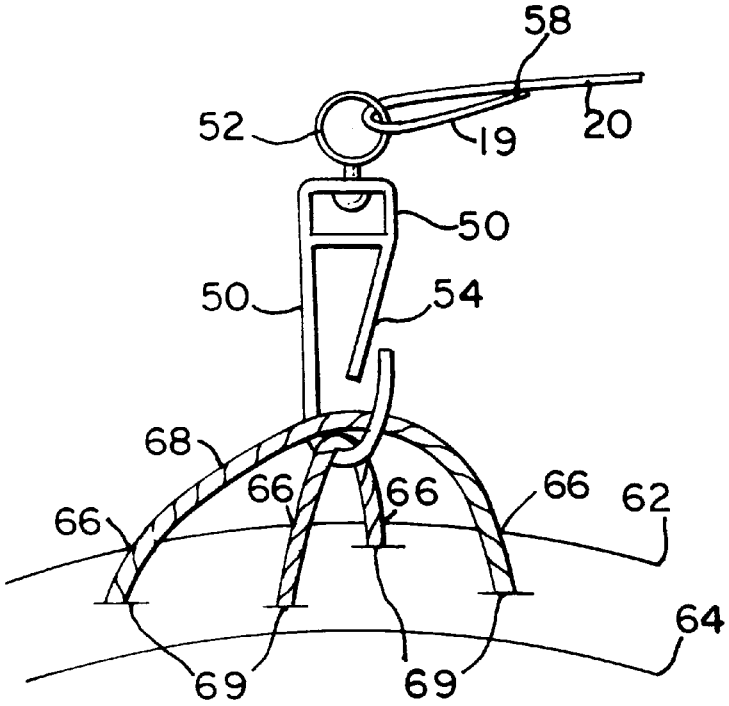
FIG. 6 is a close-up cross-sectional view of the mechanism for connecting the elastic cord to the two-piece inflatable ball of FIG. 4.

Reference is now made to FIG. 4 depicting an apparatus constructed in accordance with a second embodiment of the present invention. In this second embodiment, like elements are given like reference numerals. Elastic band 10, swivel joint 25 and all of its component parts, and elastic cord 20 operate and are formed in a fashion similar to that in the first embodiment except elastic band 10 is fastened about user's leg 5 instead of user's wrist 3. However, in this second embodiment, as shown in FIG. 6, a latchable hook 50 is connected to second end 19 of elastic cord 20, which is not connected to elastic band 10. Elastic cord 20 is looped through an eye portion 52 of latchable hook 50. Eye 52 is connected to hook member 54 of latchable hook 50 through a ball and socket connector 56. After being looped through eye 52, elastic cord 20 is secured to itself by plastic pinch fastener 58 thereby forming an enclosed circle encompassing eye 52. Thus, latchable hook 50 is securely fastened to the second end of elastic cord 20.

Figure 7:
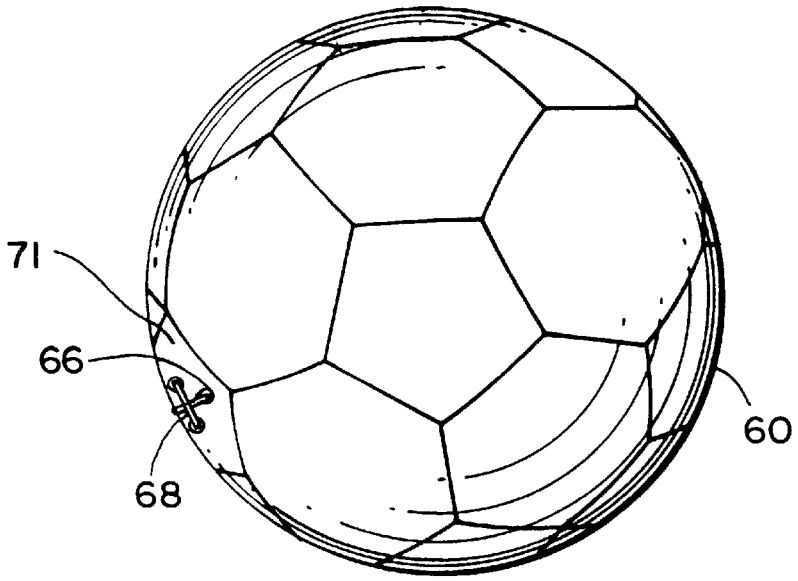
FIG. 7 is a perspective view showing the stitching on the two-piece inflatable of FIG. 4.
Figure 5:
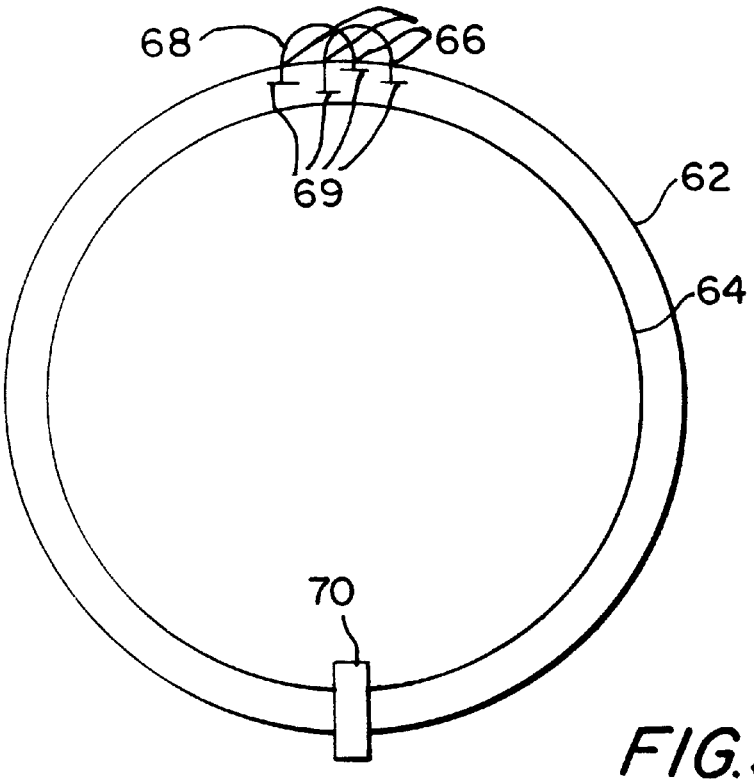
FIG. 5 is a cross-sectional view of the two-piece inflatable ball of FIG. 4.

Reference is now made to FIG. 5, which depicts a cross-section of a soccer ball 60 to which latchable hook 50 will be attached. Although this embodiment depicts the use of a soccer ball 60, any ball or other object containing an outer resilient layer, and an inner malleable airtight layer may be used. As is shown in FIG. 5, soccer ball 60 is formed with outer resilient layer 62 and inner malleable airtight layer 64 with an air valve 70 formed therein. Outer resilient layer 62 is formed with a plurality of holes 66 formed therein. In a preferred embodiment, four holes are used, but any number of holes greater than one may suffice. Stitching members 68 are inserted in each hole 66. Each piece of stitching member 68 reaches between two holes. In a preferred embodiment, therefore, two pieces of stitching would be used in order to join each pair of holes 66. This stitching should be formed in a manner so as to cross over each other to allow for ease in connecting latchable hook 50 to stitching members 68. This would result in a soccer ball 60 having stitching such as is shown in FIG. 7. However, other configurations of stitching members 68, which allow latchable hook 50 to the connected thereto may be used.

Each end of stitching members 68 is retained below outer layer 62 through the use of retention members 69. One retention member 69 is used at each end of stitching members 68. In a preferred embodiment, one retention member 69 is used with each hole 66 in outer resilient layer 62.

Figure 8:
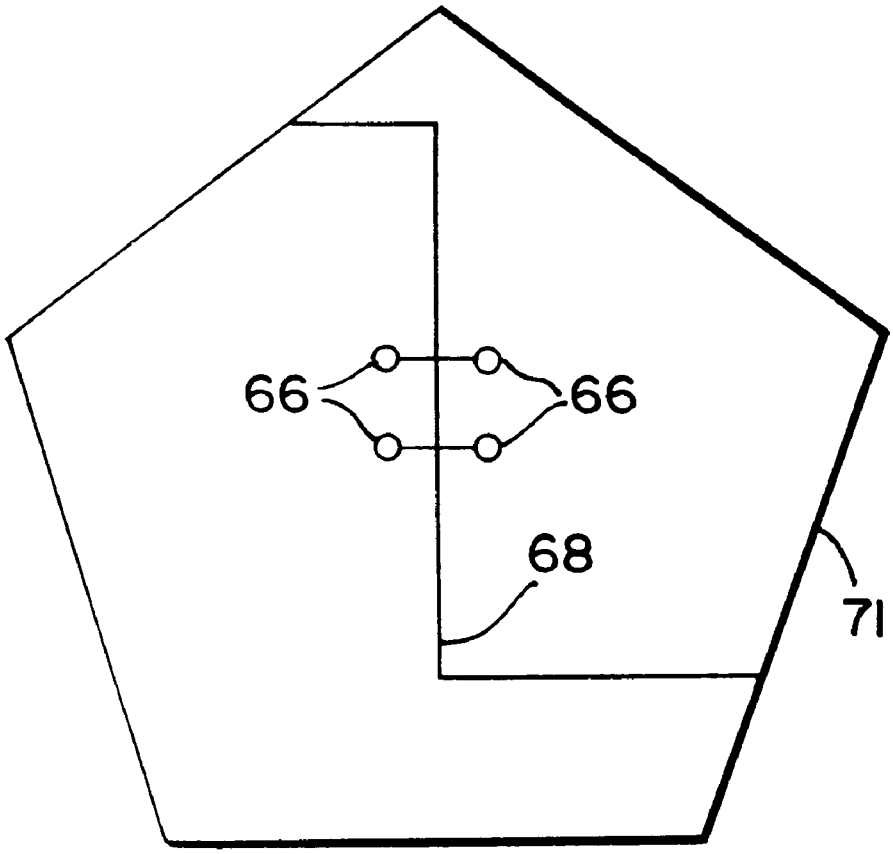
FIG. 8 is an underside perspective view of a panel of the ball of FIG. 4, showing the internal stitching thereof.

However, if more than one piece of stitching member 68 terminates in a particular hole 66, more than one retention member may be used in conjunction with that particular hole 66. In an alternative embodiment, it is possible not to utilize retention members 69, but rather to fix stitching member 68 to the edge of a panel 71 of soccer ball 60 as is shown in FIG. 8, which depicts a panel 71 of ball 60 of FIG. 7 from the underside.

After completion of the stitching of soccer ball 60, a user first connects latchable hook 50 to stitching 68, thereby securing soccer ball 60 to latchable hook 50. Elastic band 10 is then attached about user's ankle 5. Thus, upon kicking or throwing of the soccer ball away from a user, elastic cord 20 will be deformed in the Lengthwise direction. Elastic cord 20 will thereafter return soccer ball 60 to the user upon returning to its original shape. In this manner, the user may practice with a soccer ball without the fear that soccer ball 60 will be lost by the user.

It will thus be seen that the objects set forth above, among those made apparent from the preceding description, are efficiently attained and, since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention described herein described and all statements of the scope of the invention which, as a matter of language, might be said to fall therebetween.

What is claimed is:

1. A ball secure and retrieval apparatus for use with a two part inflatable ball, comprising:

a two part inflatable ball formed of an outer resilient layer and an inner malleable airtight layer;

a plurality of thread holes formed in said outer layer;

one or more stitching members, each extending between a pair of said plurality of holes;

a latchable hook adapted to be removably coupled with said stitching members;

a second end of an elastic cord coupled with said latchable hook; and a first end of said elastic cord attached to an elastic band adapted to be secured about a user's body part, wherein said elastic cord is formed of a material, said material being formed of a mixture of four parts of a first component and five parts of a second component, said first component having a hardness on the Shore A scale of 18, a specific gravity of 0.9 g/cc, a tensile modulus at 300% elongation in the flow direction of 110 psi, a tensile strength at break in the flow direction of 250 psi and a percent elongation at break in the flow direction of 300%, said second material having a hardness on the Shore A scale of 65 for injection and 62 for extrusion, a specific gravity of 0.9 g/cc, a tensile modulus at 300% elongation in the flow direction of 600 psi, a tensile strength at break in the flow direction of 1,150 psi and a percent elongation at break in the flow direction of 650%.

2. The apparatus of claim 1, further comprising a swivel joint for connecting said elastic cord and said elastic band.

3. The apparatus of claim 2, further comprising a rivet for connecting said swivel joint and said elastic band.

4. The apparatus of claim 2, wherein said elastic cord is tied to said swivel joint.

5. The apparatus of claim 1, wherein said elastic cord is formed of a material sufficiently elastic to allow deformation of said elastic cord in its longitudinal direction sufficient to ensure said user's body part is not wrenched, said material also being strong enough to ensure that said elastic cord will not break, and said solid core ball will be returned to said user's body part.

6. The apparatus of claim 1, wherein said latchable hook is formed with a ball and socket connector.

7. The apparatus of claim 5, wherein said second end of said elastic cord is tied to an eyelet portion of said ball and socket connector.

8. The apparatus of claim 1, wherein each end of each of said one or more stitching members is retained in said respective hole by a retaining member connected thereto, each of said retaining members being retained within said outer layer, but outside said inner layer.

9. The apparatus of claim 1, wherein each end of said one or more stitching members terminates in a seam of a panel of said ball, said seam being on the inside of said outer layer.

10. A method of forming a ball secure and retrieval apparatus for use with a two part inflatable ball, comprising the steps of:

forming a plurality of holes in an outer resilient layer of a two part inflatable ball;

extending each of a plurality of stitching members between each pair of said plurality of holes;

hooking a removable hook member to said plurality of stitching members;

permanently attaching a second end of an elastic cord to said removable hook member;

providing an elastic band adapted to be secured about a user's body part; and attaching a first end of said elastic cord to said elastic band, wherein said elastic cord is formed of a material, said material being formed of a mixture of four parts of a first component and five parts of a second component, said first component having a hardness on the Shore A scale of 18, a specific gravity of 0.9 g/cc, a tensile modulus at 300% elongation in the flow direction of 110 psi, a tensile strength at break in the flow direction of 250 psi and a percent elongation at break in the flow direction of 300%, said second material having a hardness on the Shore A scale of 65 for injection and 62 for extrusion, a specific gravity of 0.9 g/cc, a tensile modulus at 300% elongation in the flow direction of 600 psi, a tensile strength at break in the flow direction of 1,150 psi and a percent elongation at break in the flow direction of 650%.

11. The method of claim 10, further comprising the steps of attaching a swivel joint to said elastic band and attaching said elastic cord to said swivel joint in order to attach said elastic cord to said elastic band.

12. The method of claim 10, further comprising the step of retaining each end of each of said stitching members in said respective holes by attaching retaining members to each end, said retaining member being retained below said outer layer but above said inner layer.

13. The method of claim 10, further comprising the step of retaining each end of each of said plurality of stitching members by terminating each said end in a seam between panels which make up said outer resilient layer, said seams being located on the inside of said outer layer.

* * * * *